US010286435B2

(12) United States Patent
Nojima et al.

(10) Patent No.: US 10,286,435 B2
(45) Date of Patent: May 14, 2019

(54) WIRE FORMING MACHINE

(71) Applicant: ASAHI-SEIKI MANUFACTURING CO., LTD., Owariasahi-shi, Aichi (JP)

(72) Inventors: Takashi Nojima, Nagoya (JP); Shingo Tada, Tokyo-to (JP)

(73) Assignee: ASAHI-SEIKI MANUFACTURING CO., LTD., Owariasahi-shi (JP)

( * ) Notice: Subject to any disclaimer, the term of this patent is extended or adjusted under 35 U.S.C. 154(b) by 0 days.

(21) Appl. No.: 16/009,452

(22) Filed: Jun. 15, 2018

(65) Prior Publication Data

US 2019/0001386 A1 Jan. 3, 2019

(30) Foreign Application Priority Data

Jun. 28, 2017 (JP) ..... 2017-126468

(51) Int. Cl.
*B21D 7/12* (2006.01)
*B21C 23/08* (2006.01)
(Continued)

(52) U.S. Cl.
CPC ..... *B21C 23/08* (2013.01); *B21C 35/04* (2013.01); *B21D 7/12* (2013.01); *B21D 11/00* (2013.01);
(Continued)

(58) Field of Classification Search
CPC ..... B21C 23/08; B21C 35/04; B21D 11/00; B21D 7/12; B21D 11/12; B21F 1/06; B21F 1/00
(Continued)

(56) References Cited

U.S. PATENT DOCUMENTS 4,700,558 A 10/1987 Mohr
6,701,765 B2 * 3/2004 Itaya ..... B21F 3/02 72/137
(Continued)

FOREIGN PATENT DOCUMENTS

JP S52-110036 U 8/1977
JP 2000-343166 A 12/2000
(Continued)

OTHER PUBLICATIONS

Apr. 19, 2018 Office Action issued in Taiwanese Patent Application No. 107108619.

*Primary Examiner* — David B Jones
(74) *Attorney, Agent, or Firm* — Oliff PLC

(57) ABSTRACT

A wire forming machine with a plurality of tools, a wire fed in a wire feeding direction including a supporting base, a main tool holder rotatably supported by the base holding one of the plurality of tools, a first control drive source configured to control a position of the main tool holder at an arbitrary rotation position; a holder supporting table rotatably supported by the supporting base, a second control drive source to control a position of the holder supporting table at an arbitrary rotation, a first sub tool holder rotatably supported by the holder supporting table about a first sub rotation axis, the sub tool holder holding one of the plurality of tools, and a first interlock mechanism including a gear group or a belt coupling interlockingly rotatably the sub tool holder to the main tool holder to transfer drive force of the first control drive source and holder.

10 Claims, 10 Drawing Sheets

(51) Int. Cl.

| | |
|---|---|
| ***B21F 1/06*** | (2006.01) |
| ***B21D 11/12*** | (2006.01) |
| ***B21F 1/00*** | (2006.01) |
| ***B21D 11/00*** | (2006.01) |
| ***B21F 3/02*** | (2006.01) |
| ***B21F 3/06*** | (2006.01) |
| ***B21C 35/04*** | (2006.01) |

(52) U.S. Cl.
CPC ..... *B21D 11/12* (2013.01); *B21F 1/00* (2013.01); *B21F 1/06* (2013.01); *B21F 3/02* (2013.01); *B21F 3/06* (2013.01)

(58) Field of Classification Search
USPC ..... 72/254, 298, 307, 310, 380, 386, 388, 72/203, 217, 381, 383; 140/92.1, 102, 140/102.5, 123
See application file for complete search history.

(56) References Cited

U.S. PATENT DOCUMENTS

| | | | | |
|---|---|---|---|---|
| 7,496,998 | B2 * | 3/2009 | Itaya ..... | B21F 3/02 29/33 F |
| 8,631,674 | B2 * | 1/2014 | Christofilis ..... | B21D 7/12 72/306 |

FOREIGN PATENT DOCUMENTS

| | | | |
|---|---|---|---|
| JP | 3291207 | B2 | 6/2002 |
| JP | 3782651 | B2 | 6/2006 |
| JP | 2009-220133 | A | 10/2009 |
| JP | 2013-107103 | A | 6/2013 |
| TW | 200906515 | A | 2/2009 |

* cited by examiner

WIRE FORMING MACHINE

BACKGROUND

1. Technical Field

The present disclosure relates to a wire forming machine including a plurality of tools separately mounted on a plurality of tool holders to form or cut a wire by controlling positions of the plurality of tool holders.

2. Related Art

A conventionally known wire forming machine of this kind includes a drive mechanism for controlling the position of a main tool holder, and a drive mechanism for controlling the position of a sub tool holder, both of which drive mechanisms are mounted on a fixed base. With the wire forming machine, either one of the main tool holder and the sub tool holder operates to enter its corresponding tool into a forming region, to form or cut a wire (for example, see FIG. 2 and paragraphs [0019], [0027] of JP 2013-107103 A).

However, in the above-described conventional wire forming machine, the plurality of drive mechanisms increase the size of the wire forming machine as a whole.

SUMMARY

A wire forming machine in the present disclosure has been made in view of the above-described circumstances, and an object thereof is to provide a wire forming machine more compact than a conventional wire forming machine.

A wire forming machine according to one aspect of the present disclosure made to achieve the object stated above is a wire forming machine that is configured to form or cut, with a plurality of tools, a wire fed in a wire feeding direction, and includes a supporting base, a main tool holder rotatably supported by the supporting base about a main rotation axis perpendicular to the wire feeding direction, the main tool holder holding one of the plurality of tools, a first control drive source configured to control a position of the main tool holder at an arbitrary rotation position, a holder supporting table rotatably supported by the supporting base about the main rotation axis, a second control drive source configured to control a position of the holder supporting table at an arbitrary rotation position about the main rotation axis, a first sub tool holder rotatably supported by the holder supporting table about a first sub rotation axis parallel to the main rotation axis, the first sub tool holder holding another one of the plurality of tools, and a first interlock mechanism including one of a gear group and a belt, and coupling interlockingly rotatably the first sub tool holder to the main tool holder to transfer drive force of the first control drive source to the first sub tool holder.

BRIEF DESCRIPTION OF DRAWINGS

FIG. 5 is a cross-sectional view of a drive system of the first and second sub tool holders and the like;

DETAILED DESCRIPTION

Figure 1:
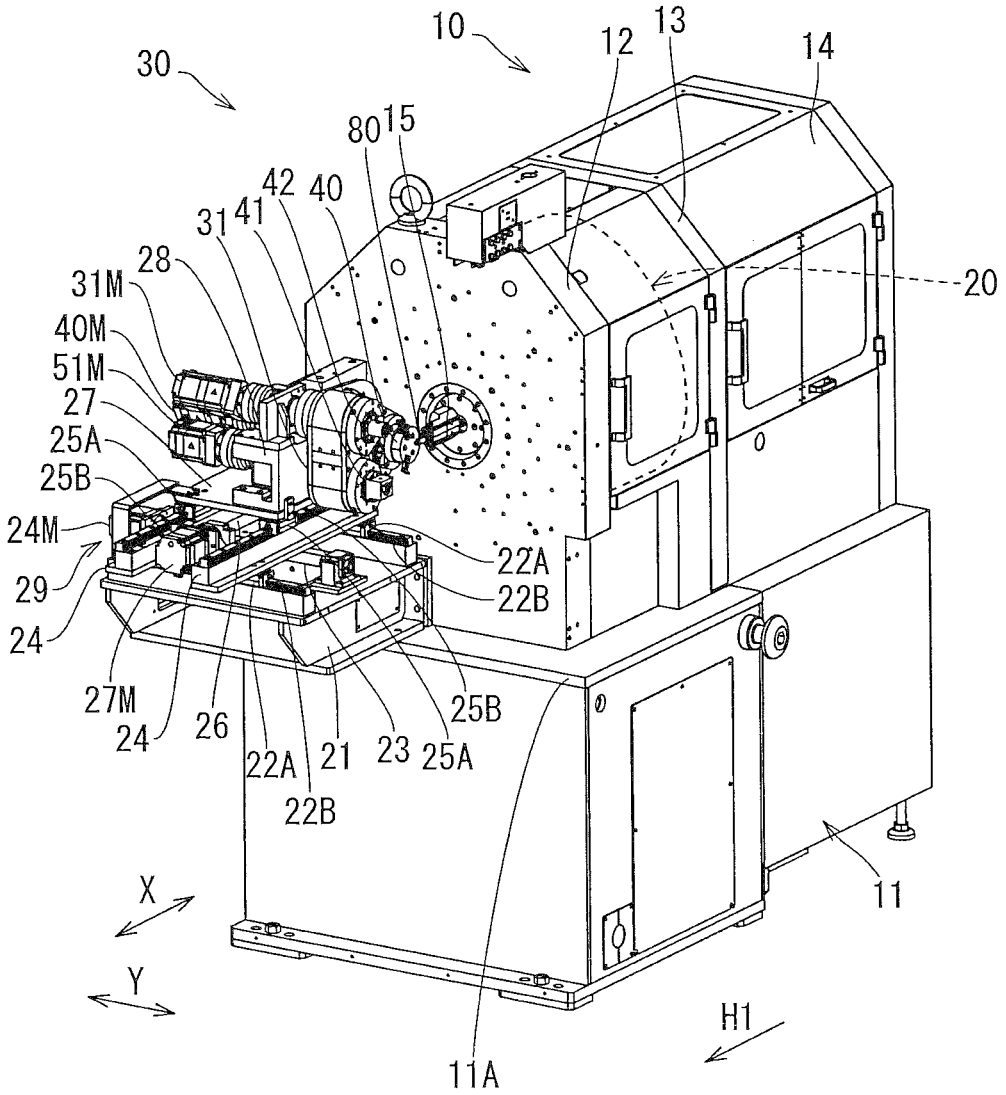
FIG. 1 is a perspective view of a wire forming machine according to one embodiment.

Hereinafter, with reference to FIGS. 1 to 9, a description will be given of one embodiment. FIG. 1 shows the entire wire forming machine 10 according to the present embodiment. The wire forming machine 10 includes a tool supporting mechanism 30 at an outer surface of a supporting frame 11 supporting a wire feeding apparatus 20.

The supporting frame 11 includes a supporting pedestal 11A being rectangular as seen in a plan view. A first supporting wall 12 and a second supporting wall 13 rise from a one-end-side position and an intermediate position in the longitudinal direction of an upper surface of the supporting pedestal 11A. A cover 14 supported by the first and second supporting walls 12, 13 covers substantially the entire upper surface of the supporting pedestal 11A.

A quill 15 projects from the center of an outer surface of the first supporting wall 12, and a wire guide hole (not shown) horizontally penetrates through the quill 15. A wire 99 is drawn from an end of the cover 14 that is opposite to the first supporting wall 12, into the wire feeding apparatus 20 in the cover 14. The wire 99 penetrates through the first and second supporting walls 12, 13 and is fed forward from the quill 15 (see FIG. 2). That is, in the present embodiment, an imaginary line extending forward from a center axis of the wire guide hole is a wire feeding line L1 (see FIG. 3), and the direction in which the wire feeding line L1 extends forward is a wire feeding direction H1.

Figure 2:
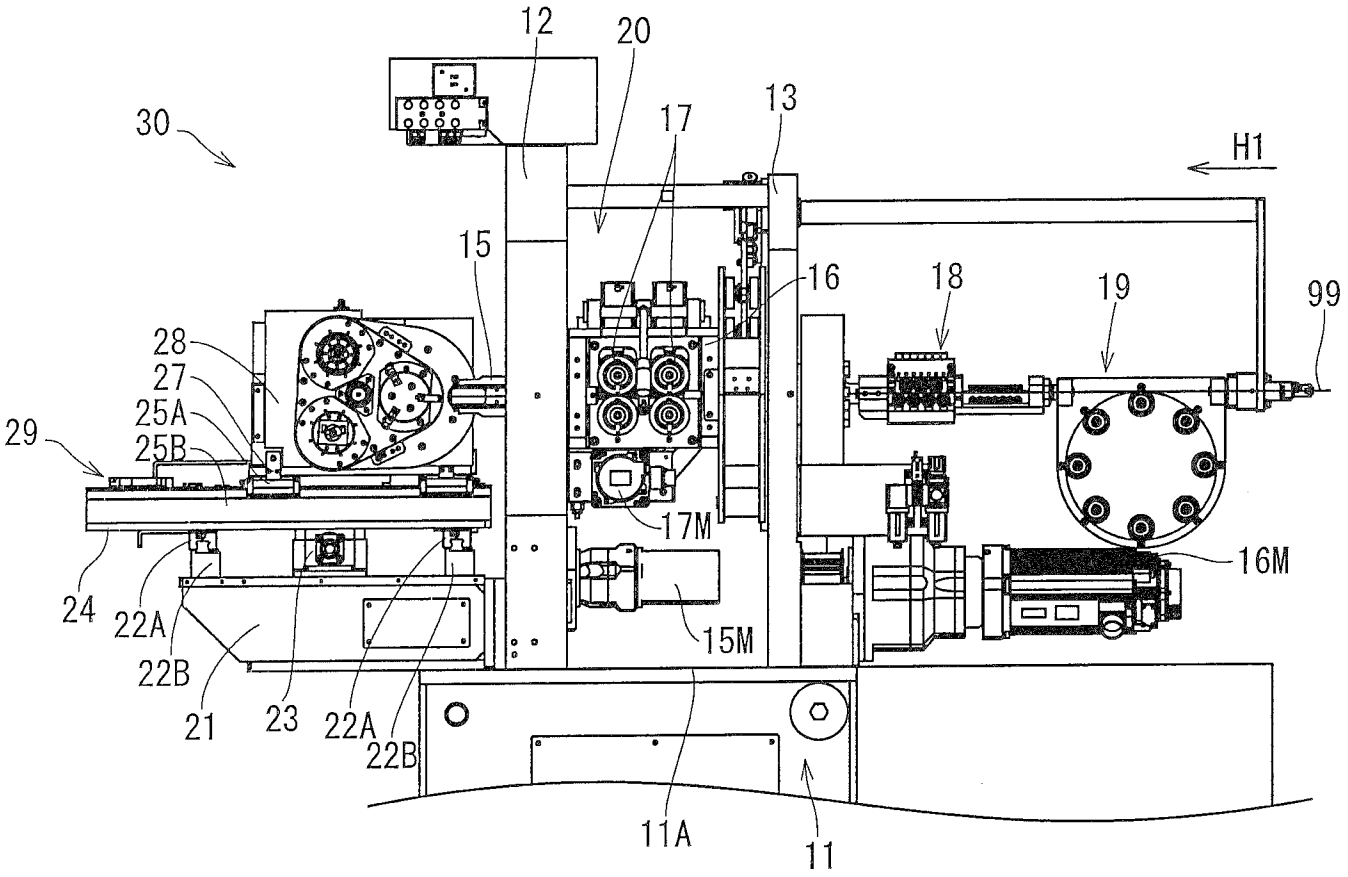
FIG. 2 is a side view of the wire forming machine from which a cover is removed.

Note that, as shown in FIG. 2, the wire feeding apparatus 20 includes two pairs of feeding rollers 17 supported by a roller supporting base 16 interposed between the first and second supporting walls 12, 13. The two pairs of feeding rollers 17 are driven to rotate by a servomotor 17M while holding the wire 99 therebetween, thereby the wire 99 is fed to the quill 15. Further, the quill 15 and the roller supporting base 16 are driven to rotate by servomotors 15M, 16M about the wire feeding line L1. Further, at one end of the roller supporting base 16 penetrating through the second supporting wall 13, first and second correcting machines 18, 19 are mounted, so that the wire 99 is corrected to be straight.

As shown in FIG. 1, the tool supporting mechanism 30 includes a fixed table 21 supported by the supporting frame 11, and further includes an X-Y table 29 on the fixed table 21. The fixed table 21 is arranged closer to one end side in the right-left direction of the first supporting wall 12. The fixed table 21 is fixed with its two surfaces overlaid on a lower end of an outer surface of the first supporting wall 12 and an upper surface of the supporting pedestal 11A. Hereinafter, a horizontal direction parallel to the wire feeding direction H1 is referred to as the "X-direction" and a horizontal direction perpendicular to the wire feeding direction H1 is referred to as the "Y-direction". In the following, a description will be given of the structure of the X-Y table 29.

At an upper surface of the fixed table 21, a pair of rail parts 22B, 22B extending in the Y-direction is provided.

Sliders 22A, 22A slidably engaging with the rail parts 22B, 22B are fixed to the lower surface of a Y table 24. By a ball screw mechanism 23 whose drive source is a servomotor 24M, the position of the Y table 24 is controlled in the Y-direction. Further, at an upper surface of the Y table 24, a pair of rail parts 25B, 25B extending in the X-direction is provided. Sliders 25A, 25A slidably engaging with the rail parts 25B, 25B are fixed to the lower surface of an X table 27. By a ball screw mechanism 26 whose drive source is a servomotor 27M, the position of the X table 27 is controlled in the X-direction. The foregoing components structure the X-Y table 29.

Figure 3:
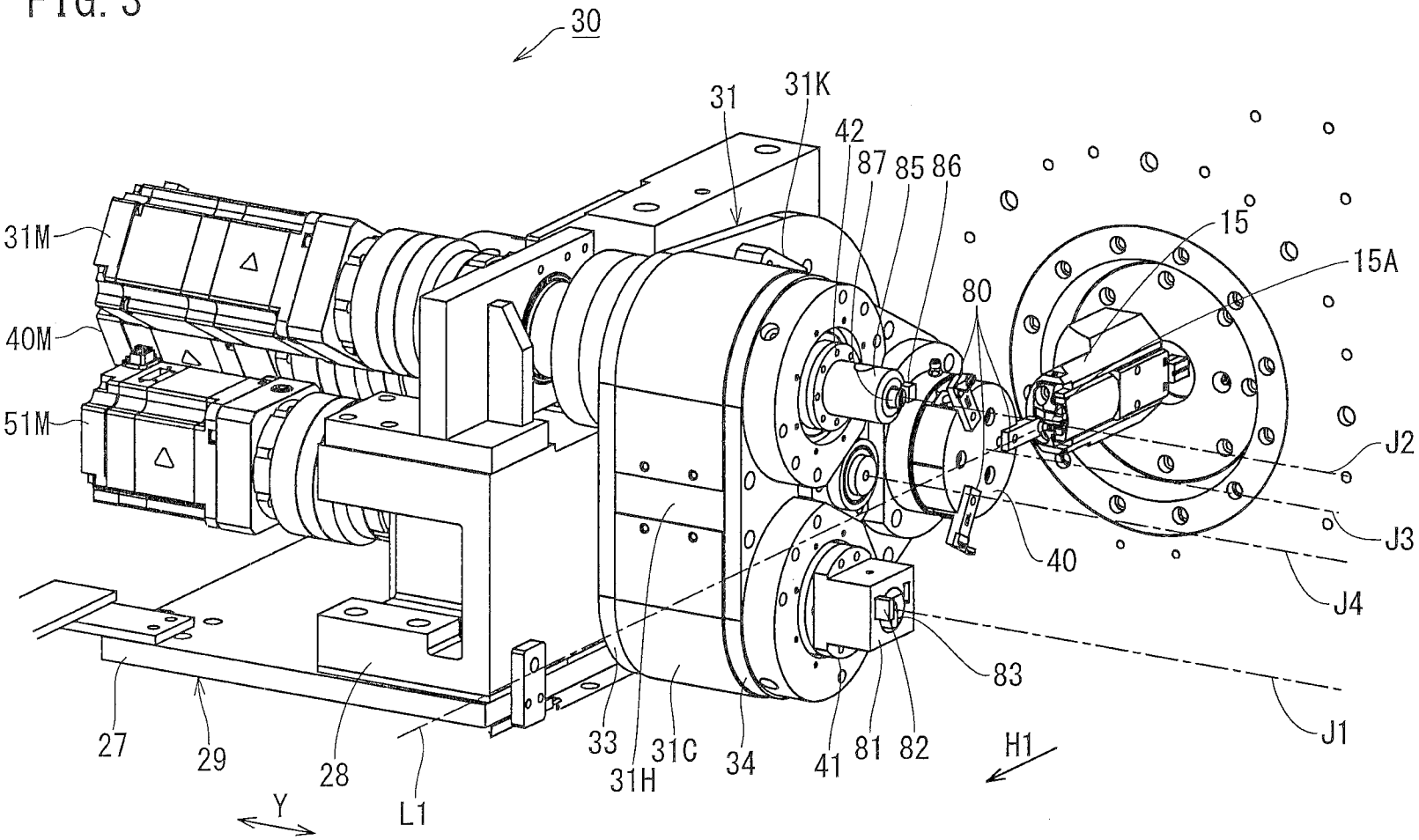
FIG. 3 is a partial enlarged perspective view of the wire forming machine.

As shown in FIG. 3, a supporting base 28 rises from an upper surface of the X table 27, and arranged at a position spaced apart from the wire feeding line L1 on one side in the Y-direction. Hereinafter, unless otherwise specified, as to the components structuring the tool supporting mechanism 30 on the X table 27, the Y-direction is referred to as the "front-rear direction". In the Y-direction, a side closer to the wire feeding line L1 is referred to as the "front side", "front", or the like, and a side away from the wire feeding line L1 is referred to as the "rear side", "rear", or the like.

The supporting base 28 rises from the front side edge of the X table 27. On the front surface side of the supporting base 28, a holder supporting table 31 is provided. Further, on the front surface side of the holder supporting table 31, a main tool holder 40 and first and second sub tool holders 41, 42 are provided. The holder supporting table 31 and the main tool holder 40 rotate relative to the supporting base 28 about a common center axis, namely a main rotation axis J3. Further, the first sub tool holder 41 rotates relative to the holder supporting table 31 about a first sub rotation axis J1 parallel to the main rotation axis J3. The second sub tool holder 42 rotates relative to the holder supporting table 31 about a second sub rotation axis J2 parallel to the main rotation axis J3 and the first sub rotation axis J1.

Figure 4:
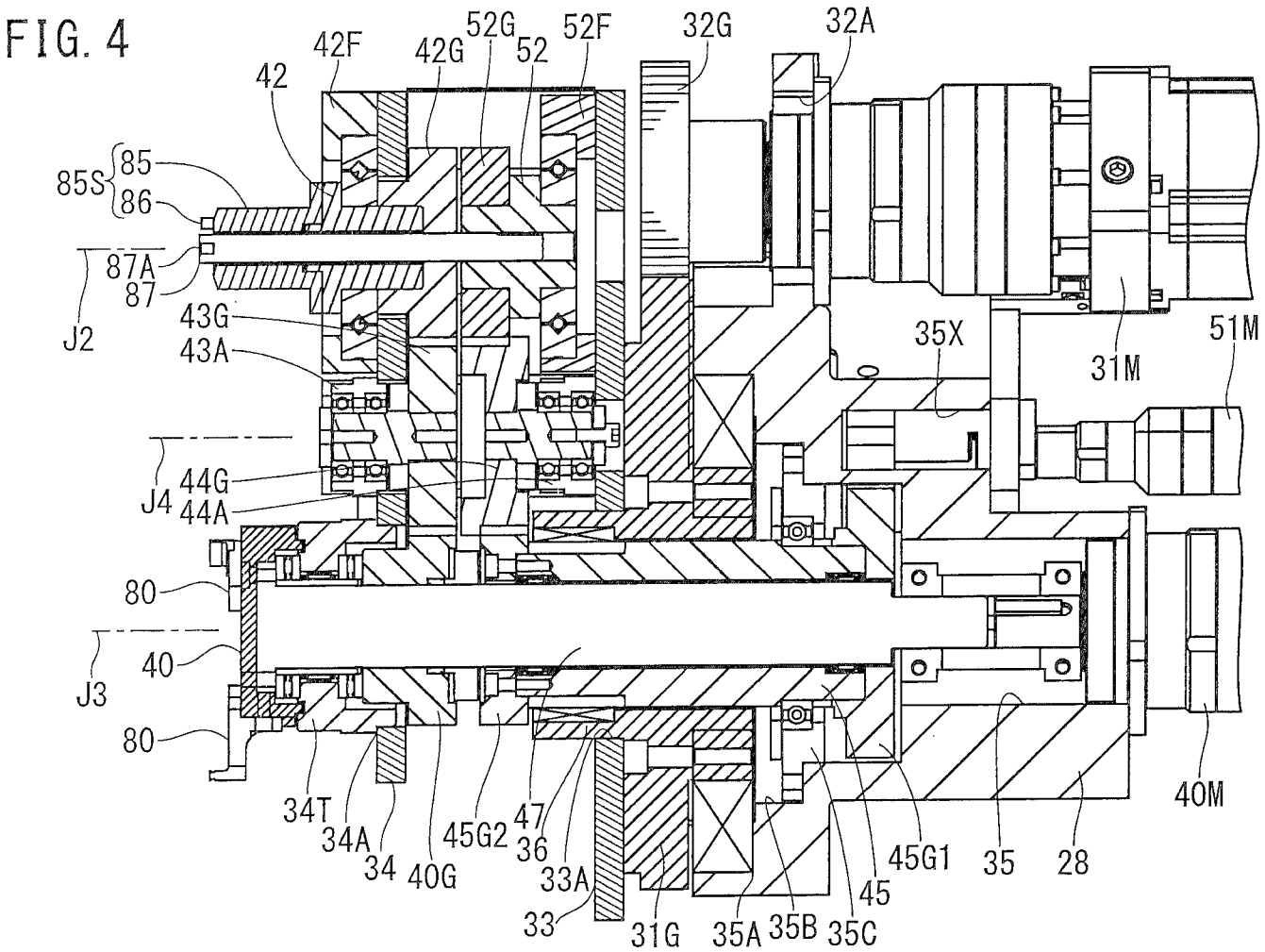
FIG. 4 is a section view as to a drive system of a main tool holder and a second sub tool holder taken along line IV-IV in FIG. 7.

In detail, the main rotation axis J3 is arranged at a position crossing the wire feeding line L1. As shown in FIG. 4, at the supporting base 28, a center hole 35 whose center axis is the main rotation axis J3 is formed. The diameter of the center hole 35 increases stepwise frontward. A first drive sleeve 36 is rotatably supported, via bearings, inside a great diameter part 35A at the front end of the center hole 35, and projects frontward relative to the supporting base 28.

In the first drive sleeve 36, from a portion projecting from the supporting base 28, a gear 31G laterally extends. The gear 31G meshes with a gear 32G fixed to the output shaft of a servomotor 31M (corresponding to the "second control drive source"). The servomotor 31M is mounted on the rear end opening edge of a motor mounting hole 32A formed at the supporting base 28. Note that, the servomotor 31M integrally includes a speed reducer on its output side. The same holds true for servomotors 40M, 51M, which will be described later.

In the first drive sleeve 36, a front-side portion located more frontward than the gear 31G is fitted into a through hole 33A of a rear-side supporting plate 33, which will be described later, and the rear-side supporting plate 33 and the first drive sleeve 36 are integrally rotatably fixed together.

Further, a second drive sleeve 45 (corresponding to the "relay member") penetrates through inside the first drive sleeve 36. The second drive sleeve 45 is rotatably supported at its rear-end-side position, via bearings, by a bracket 35C fixed to an intermediate part 35B of the center hole 35, and is rotatably supported at its front-end-side position, via bearings, by the front end of the first drive sleeve 36. Further, a gear 45G1 is fixed to the rear end of the second drive sleeve 45. The gear 45G1 meshes with a gear 46G (see FIG. 9) fixed to the output shaft of the servomotor 51M (corresponding to the "third control drive source"). The servomotor 51M is mounted on the rear end opening edge of a motor mounting hole 35X that communicates with a portion for accommodating the gear 45G1 in the center hole 35. Further, a second side gear 45G2 is fixed to the front end of the second drive sleeve 45 projecting frontward relative to the first drive sleeve 36.

Figure 6:
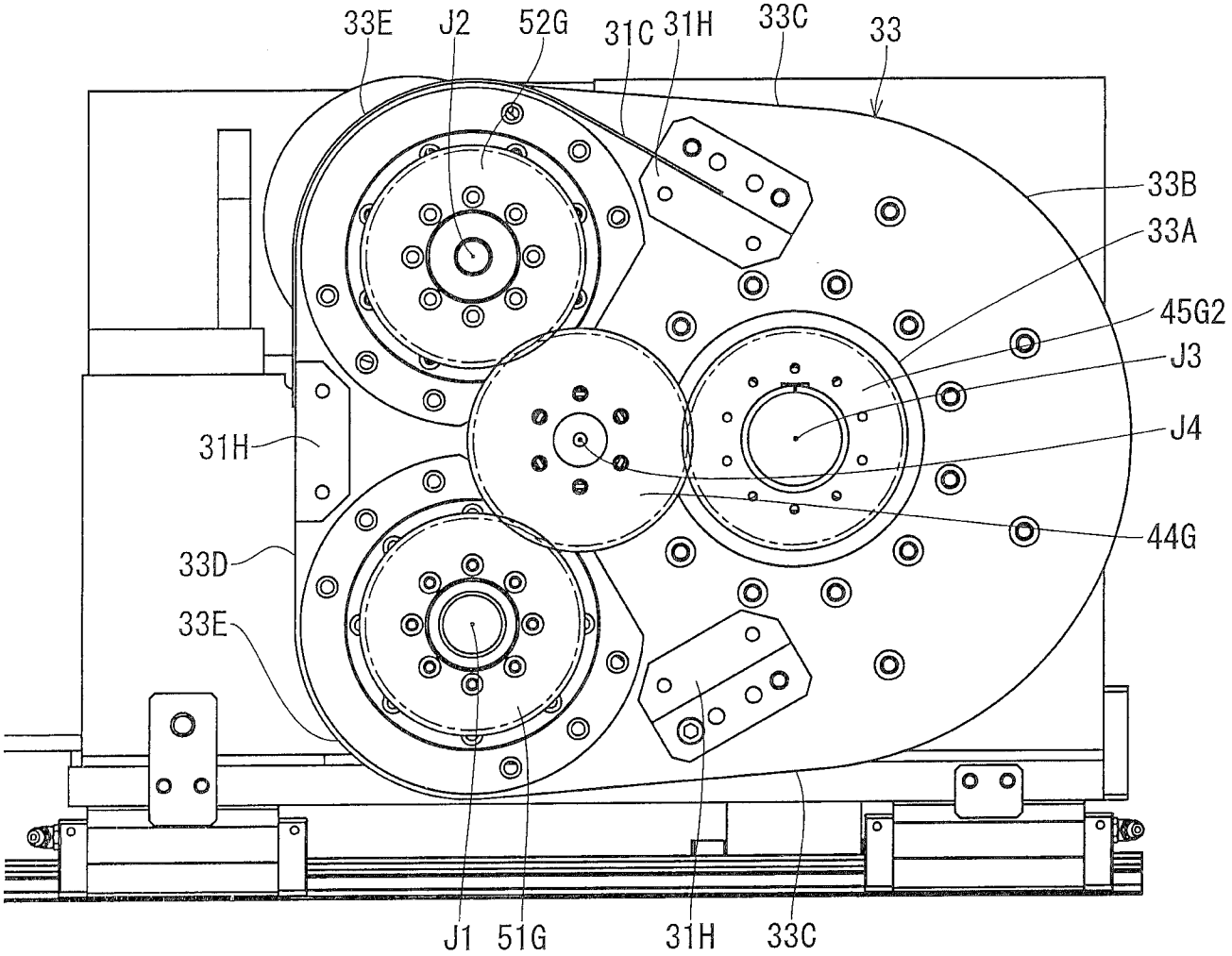
FIG. 6 is a front view of a rear-side supporting plate.

As shown in FIG. 6, the outer edge shape of the rear-side supporting plate 33 is defined by a substantially semicircular great arc part 33B about the through hole 33A, a pair of straight parts 33C, 33C extending from the opposite ends of the great arc part 33B extending in their tangent direction, a straight part 33D extending between the ends of the pair of straight parts 33C, 33C, and a pair of corner arc parts 33E, 33E formed by rounding the corner portions between the straight part 33D and the pair of straight parts 33C, 33C.

In the rear-side supporting plate 33, to substantially the center of a line connecting between the main rotation axis J3 and the straight part 33D by the shortest distance, a supporting sleeve 44A is fixed and projects frontward (see FIG. 4). The supporting shaft of a second idle gear 44G is supported by bearings in the supporting sleeve 44A, so as to rotate about an idle rotation axis J4.

Figure 5:
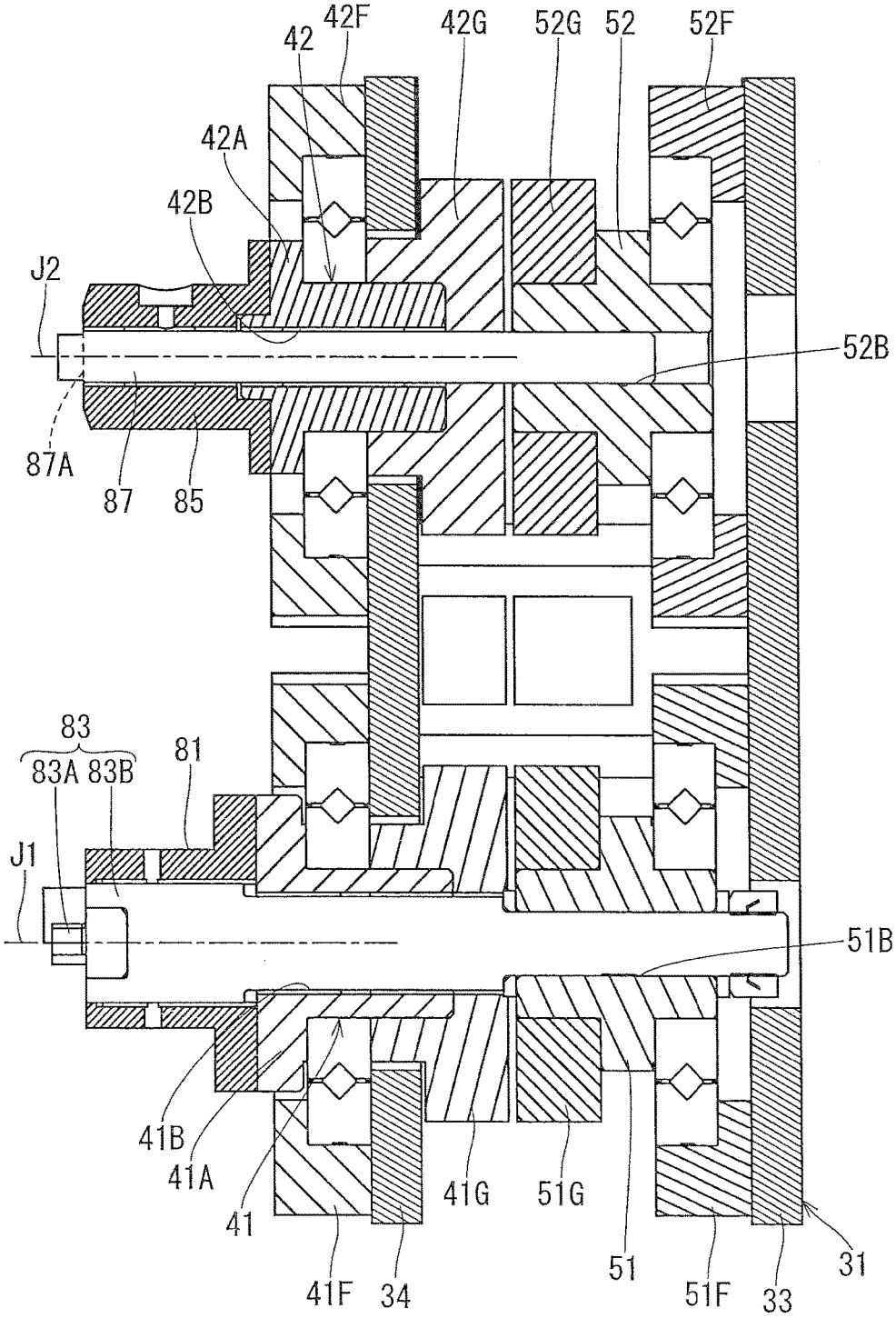

At the rear-side supporting plate 33, the main rotation axis J3, the first sub rotation axis J1, and the second sub rotation axis J2 are arranged at three positions trisecting a circle about the idle rotation axis J4. The first sub rotation axis J1 is positioned at the center of the corner arc part 33E on the lower side in FIG. 6, and the second sub rotation axis J2 is positioned at the center of the corner arc part 33E on the upper side in FIG. 6. As shown in FIG. 5, to the front surface of the rear-side supporting plate 33, a supporting ring 51F being annular about the first sub rotation axis J1 and a supporting ring 52F being annular about the second sub rotation axis J2 are fixed.

Figure 9:
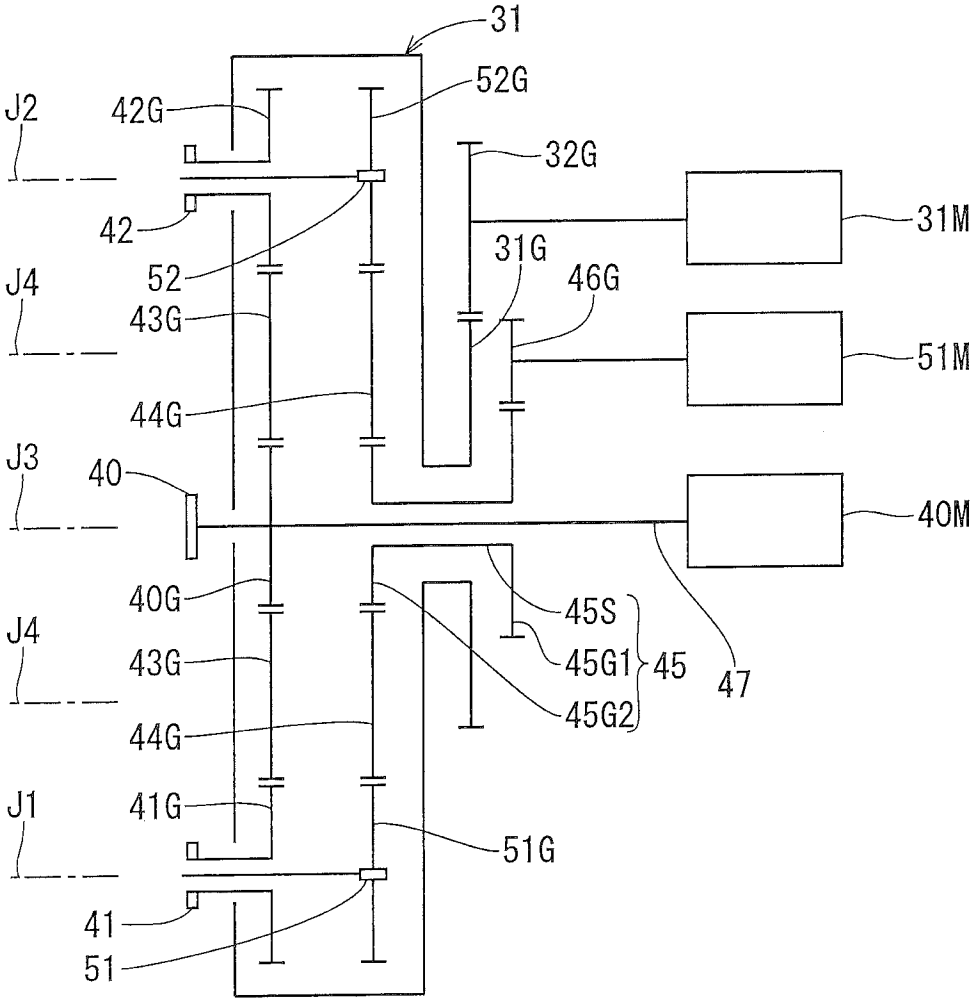
FIG. 9 is a conceptual diagram of a drive system of the tool holders of the wire forming machine.

As shown in FIG. 5, the supporting ring 51F rotatably supports, via bearings, a first coaxial tool holder 51, and the supporting ring 52F rotatably supports, via bearings, a second coaxial tool holder 52. Further, to the first coaxial tool holder 51, a second side gear 51G is fixed integrally rotatably. To the second coaxial tool holder 52, a second side gear 52G is fixed integrally rotatably. The three second side gears 45G2, 51G, 52G including the second side gear 45G2 at the front edge of the second drive sleeve 45 mesh with three locations in the circumferential direction of the second idle gear 44G (see FIG. 6). Thus, by the servomotor 51M, the first and second coaxial tool holders 51, 52 rotate interlockingly. Note that, FIG. 9 is a conceptual diagram of a drive system that transfers drive force from the servomotor 51M to the first and second coaxial tool holders 51, 52. Further, while FIG. 9 shows the idle rotation axis J4 and the second idle gear 44G by two pieces each in order to provide a developed view, they are actually one in number each. The same holds true for a first idle gear 43G described later.

Figure 7:
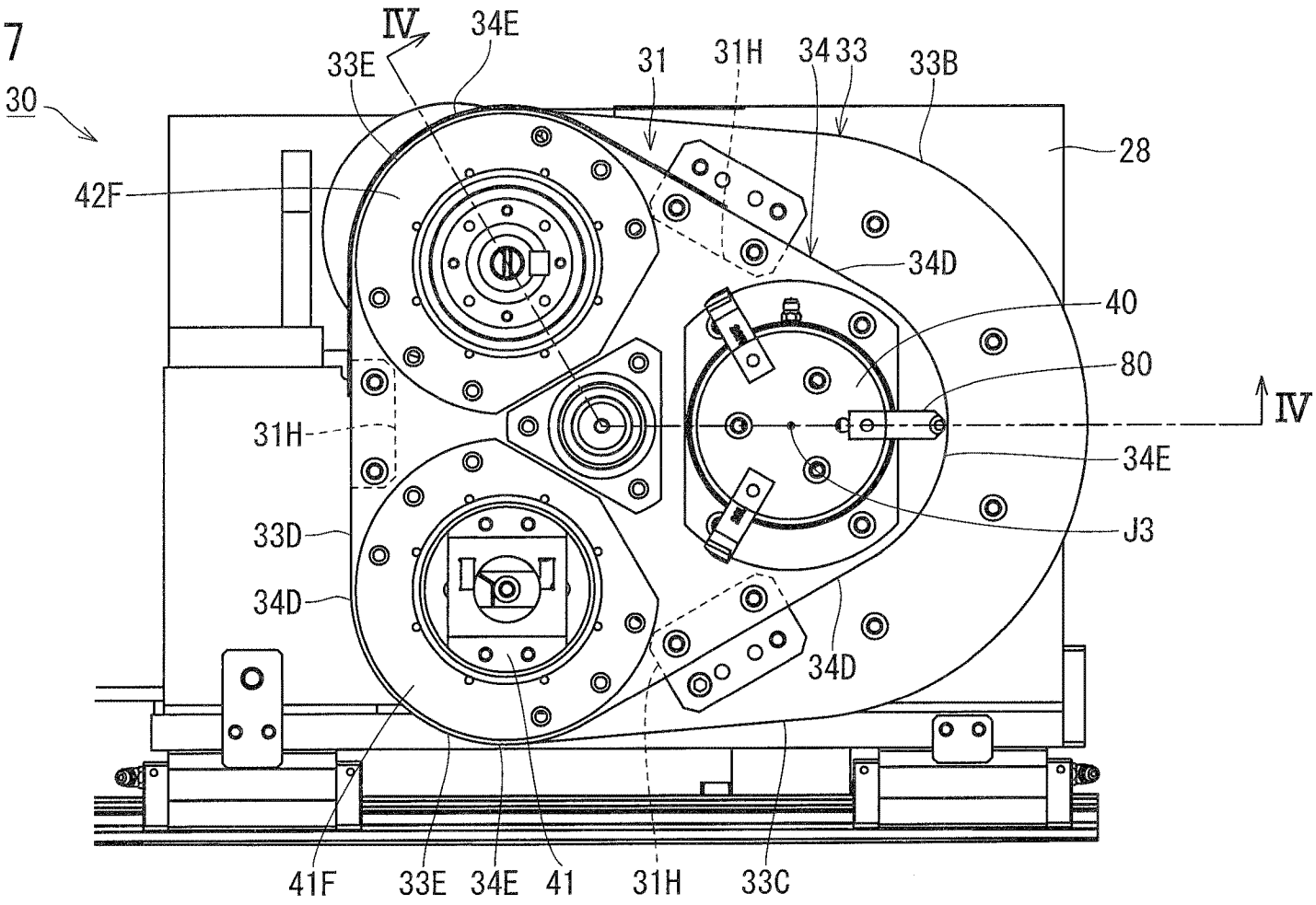
FIG. 7 is a front view of a front-side supporting plate.

As shown in FIG. 3, in front of the rear-side supporting plate 33, a front-side supporting plate 34 having a substantially triangular shape is arranged so as to be opposed to the rear-side supporting plate 33, with a strut member 31H interposed between the front-side supporting plate 34 and the rear-side supporting plate 33. As shown in FIG. 7, the front-side supporting plate 34 includes a corner arc part 34E that is identical in shape to the corner arc part 33E of the rear-side supporting plate 33, at each of three corner parts. Among the three corner arc parts 34E, a pair of the corner arc parts 34E, 34E are arranged to be overlaid on a pair of the corner arc parts 33E, 33E of the rear-side supporting plate 33 from the front side. The remaining corner arc part 34E is arranged so that its center axis coincides with the main rotation axis J3. Further, as shown in FIG. 7, the strut members 31H are respectively disposed at the centers of the edge parts along the straight parts 34D between the adjacent corner arc parts 34E, 34E in the front-side supporting plate 34, and fixed to the rear-side supporting plate 33 and the front-side supporting plate 34. Further, as shown in FIG. 3, between the rear-side supporting plate 33 and the front-side supporting plate 34, three covers 31C each having a substantially U-shape and each including legs being open to separate from each other are mounted to respectively span the three corner parts of the front-side supporting plate 34, and to have their opposite ends fixed to the strut members 31H. The holder supporting table 31 includes the rear-side supporting plate 33, the front-side supporting plate 34, the strut members 31H, and the covers 31C. By the above-described servomotor 31M, the holder supporting table 31 rotates about the main rotation axis J3.

As shown in FIG. 4, at the front-side supporting plate 34, a through hole 34A is formed on the main rotation axis J3. A supporting sleeve 34T fixed to the opening edge of the through hole 34A projects frontward relative to the front-side supporting plate 34. Further, a drive shaft 47 penetrates through inside the second drive sleeve 45. The drive shaft 47 has its rear end coupled integrally rotatably to the output shaft of a servomotor 40M (corresponding to the "first control drive source") mounted on the rear end opening edge of the center hole 35. Further, the front end of the drive shaft 47 projects frontward relative to the supporting sleeve 34T. The main tool holder 40 is fixed to the front end of the drive shaft 47. The main tool holder 40 has a flat cap-shape fitting to the front end of the drive shaft 47. Three tools 80 are respectively fixed at three positions in the front end surface of the main tool holder 40 circumferentially trisecting the front end surface, and the tools 80 laterally radially project from the main tool holder 40 (see FIG. 3).

As shown in FIG. 5, on the first sub rotation axis J1 of the front-side supporting plate 34, the first sub tool holder 41 is rotatably supported. A first side gear 41G is rotatably mounted on the first sub tool holder 41. Further, on the second sub rotation axis J2 of the front-side supporting plate 34, the second sub tool holder 42 is rotatably supported. A first side gear 42G is rotatably mounted on the second sub tool holder 42. Further, as shown in FIG. 4, a first side gear 40G is fixed integrally rotatably at a front-end-side position in the drive shaft 47. A first idle gear 43G is rotatably mounted on the idle rotation axis J4 of the front-side supporting plate 34. Three locations in the circumferential direction of the first idle gear 43G mesh with the three first side gears 40G, 41G, 42G. Thus, by the servomotor 40M, the main tool holder 40 and the first and second sub tool holders 41, 42 rotate interlockingly. Note that, FIG. 9 conceptually shows a drive system that transfers drive force from the servomotor 40M to the main tool holder 40, and the first and second sub tool holders 41, 42.

In detail, as shown in FIG. 4, at the front-side supporting plate 34, a through hole is formed about the idle rotation axis J4. At the front surface of the front-side supporting plate 34, a supporting sleeve 43A is fixed on the idle rotation axis J4. A supporting shaft rotatably supported by bearings in the supporting sleeve 43A projects rearward relative to the front-side supporting plate 34. The first idle gear 43G is coupled to the projecting portion of the supporting sleeve 43A. Similarly, as shown in FIG. 5, at the front-side supporting plate 34, through holes are formed respectively about the first and second sub rotation axes J1, J2. Supporting rings 41F, 42F are respectively fixed to the front surface of the through holes. The first sub tool holder 41 is rotatably supported by bearings in the supporting ring 41F. The rear end of the first sub tool holder 41 and the first side gear 41G on the rear surface side of the front-side supporting plate 34 are integrally rotatably coupled together. Further, the second sub tool holder 42 is rotatably supported by bearings in the supporting ring 42F. The rear end of the second sub tool holder 42 and the first side gear 42G on the rear surface side of the front-side supporting plate 34 are integrally rotatably coupled together.

As shown in FIG. 5, a flange part 41A laterally extends from the front end of the first sub tool holder 41. A center hole 41B penetrates through the center of the first sub tool holder 41. Similarly, a flange 42A laterally extends from the front end of the second sub tool holder 42. A center hole 42B penetrates through the center of the second sub tool holder 42. Corresponding thereto, at the center of the first coaxial tool holder 51 positioned coaxially on the rear side of the first sub tool holder 41, a tool coupling hole 51B is formed. At the center of the second coaxial tool holder 52 positioned coaxially on the rear side of the second sub tool holder 42, a tool coupling hole 52B is formed.

Figure 8:
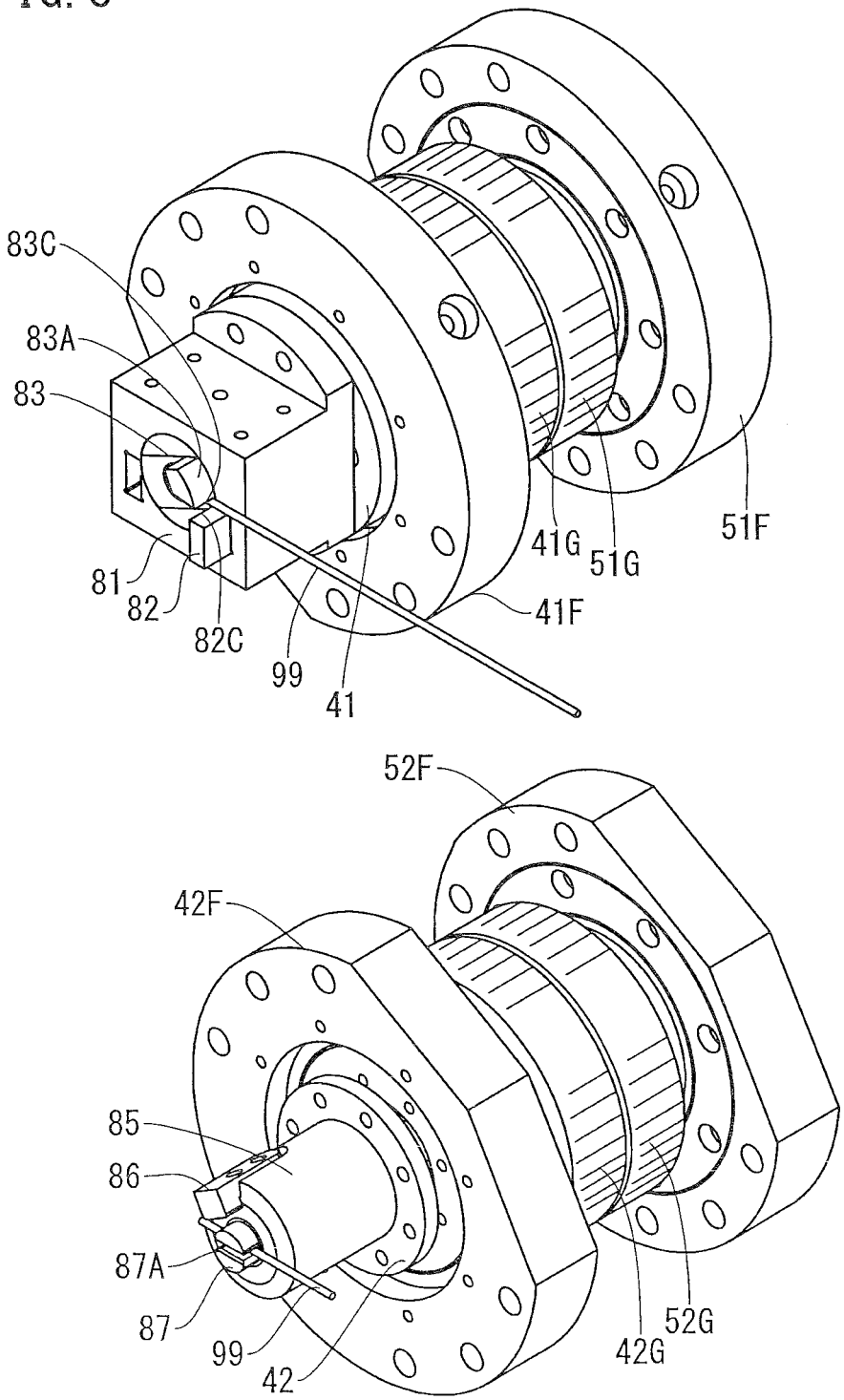
FIG. 8 is a perspective view of drive systems of the sub tool holders and coaxial tool holders.

To the first coaxial tool holder 51, a first cutting tool 83 is fixed. The first cutting tool 83 includes a shaft 83B extending along the first sub rotation axis J1 and a first cutter 83A (see FIG. 8) attached to the tip surface of the shaft 83B. The basal end of the first cutting tool 83 is coupled integrally rotatably to the tool coupling hole 51B of the first coaxial tool holder 51 (see FIG. 5) by a key (not shown). Further, as shown in FIG. 8, to the front surface of the first sub tool holder 41, a second cutting tool 81 is fixed. The second cutting tool 81 includes a prismatic body and a second cutter 82 projecting from the front end surface of the prismatic body. The front end of the first cutting tool 83 projects frontward than the front end surface of the second cutting tool 81. A wire 99 is set between the first and second cutters 83A, 82 and cut by blade parts 83C, 82C at the side surfaces of the first and second cutters 83A, 82.

To the second coaxial tool holder 52, a first bending tool 87 is fixed. The first bending tool 87 extending in a bar-like shape along the second sub rotation axis J2 has a wire accommodating groove 87A (see FIG. 8) which crosses the tip surface in the radial direction. The basal end of the first bending tool 87 is coupled integrally rotatably to the tool coupling hole 52B of the second coaxial tool holder 52 (see FIG. 5) by a key (not shown). Further, as shown in FIG. 8, to the front surface of the second sub tool holder 42, a second bending tool 85 is fixed. The second bending tool 85 includes a cylindrical body and a prism part 86 projecting forward from the tip surface of the cylindrical body. The front end of the first bending tool 87 projects frontward than the front end surface of the second bending tool 85. In the state where the wire 99 is accommodated in the wire accommodating groove 87A, the first bending tool 87 rotates relative to the second bending tool 85, thereby bending the wire 99. Note that, in the present embodiment, the "first interlock mechanism" includes the first idle gear 43G and the three first side gears 40G, 41G, 42G. Further, the "second interlock mechanism" includes the second idle gear 44G, the three second side gears 45G2, 51G, 52G, and the second drive sleeve 45.

In the foregoing, a description has been given of the structure of the wire forming machine 10 according to the present embodiment. Next, a description will be given of operations and effects of the wire forming machine 10. As has been described above, in the wire forming machine 10 according to the present embodiment, the X-Y table 29 is shared by the first and second sub tool holders 41, 42, the first and second coaxial tool holders 51, 52, and the main tool holder 40. Further, the servomotor 40M is used in a shared manner in controlling the positions of the first and second sub tool holders 41, 42 and the main tool holder 40. Still further, the servomotor 51M is used in a shared manner in controlling the positions of the first and second coaxial tool holders 51, 52. In this manner, by virtue of the X-Y table 29 and the control drive sources (the servomotors 40M, 51M) being shared in the wire forming machine 10 according to the present embodiment, the wire forming machine 10 is more compact and smaller in power consumption than a conventional wire forming machine in which these functions are served by separate members.

Further, the provision of two sub tool holders, namely the first and second sub tool holders 41, 42 provides flexibility in selecting tool holders. In addition, by virtue of the provision of the first and second coaxial tool holders 51, 52 driven coaxially to the first and second sub tool holders 41, 42, a workpiece can be processed by cooperation of two tools. Specifically, the first and second cutting tools 81, 83 may be mounted on the first sub tool holder 41 and the first coaxial tool holder 51, to cooperatively cut the wire 99. Alternatively, the first and second bending tools 85, 87 may be mounted on the second sub tool holder 42 and the second coaxial tool holder 52, to cooperatively bend the wire 99.

Further, the first and second sub tool holders 41, 42 and the first and second coaxial tool holders 51, 52 that hold the first and second cutting tools 81, 83 and the first and second bending tools 85, 87 rotate around the main tool holder 40. Therefore, the travelable distance thereof is longer than that of the main tool holder 40. Thus, despite their being compact, the first and second sub tool holders 41, 42 can form or cut a workpiece that is conventionally hardly formed or cut because of the required long traveling distance of tools. Meanwhile, since the main tool holder 40 does not rotate like the first and second sub tool holders 41, 42, the main tool holder 40 is high in stiffness, and can form the wire 99 highly precisely.

Other Embodiments (1) While the wire forming machine 10 according to the above-described embodiment includes the sub tool holders and the coaxial tool holders rotating about the main tool holder 40 by two pieces each, the sub tool holder rotating about the main tool holder may be one, or three or more, in number. Further, the coaxial tool holders may be provided coaxially to all the plurality of sub tool holders or to a part of the plurality of sub tool holders. Alternatively, the coaxial tool holders may be provided coaxially to none of the plurality of sub tool holders.

(2) More specifically, it is also possible to employ a structure in which the second sub tool holder 42 and the second coaxial tool holder 52 are excluded from the wire forming machine 10 according to the above-described embodiment, and the first and second cutting tools 81, 83 or the first and second bending tools 85, 87 may be attached to the first sub tool holder 41 and the first coaxial tool holder 51.

(3) In the wire forming machine 10 according to the above-described embodiment, the first side gears 40G, 41G, 42G are coupled via the first idle gear 43G, and the second side gears 45G2, 51G, 52G are coupled via the second idle gear 44G. However, it is also possible to employ a structure in which the first side gears or the second side gears are coupled without intervention of the idle gear.

Figure 10:
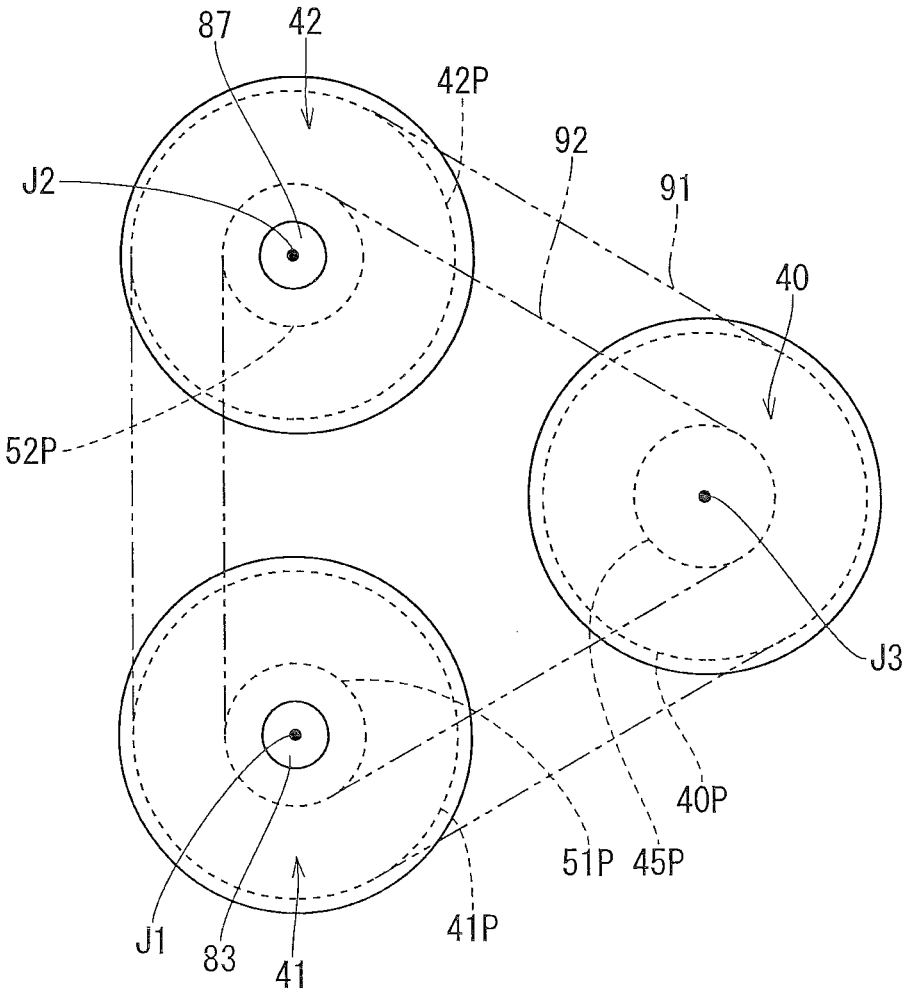
FIG. 10 is a conceptual diagram of tool holders of a wire forming machine according to another embodiment.

(4) In the above-described embodiment, the "first interlock mechanism" in which the main tool holder 40 and the first and second sub tool holders 41, 42 are coupled interlockingly rotatably to transfer the drive force of the first control drive source to the first sub tool holder includes the gear group (the first idle gear 43G, the first side gears 40G, 41G, 42G). However, it is also possible to employ a structure including pulleys 40P, 41P, 42P respectively fixed to the main tool holder 40 and the sub tool holders 41, 42, and a belt 91 wrapped around the pulleys 40P, 41P, 42P (see FIG. 10). Alternatively, it is also possible to employ a structure including sprockets respectively fixed to the tool holders 40, 41, 42, and a chain wrapped around the sprockets.

(5) In the above-described embodiment, the "second interlock mechanism" coupling interlockingly rotatably the first coaxial tool holder 51 to the second coaxial tool holder 52 includes the gear group (the second idle gear 44G, the second side gears 45G2, 51G, 52G). However, it is also possible to employ a structure including pulleys 45P, 51P, 52P respectively fixed to the second drive sleeve 45 and the first and second coaxial tool holders 51, 52, and a belt 92 wrapped around the pulleys 45P, 51P, 52P (see FIG. 10). Alternatively, it is also possible to employ a structure including sprockets respectively fixed to the second drive sleeve 45 and the first and second coaxial tool holders 51, 52, and a chain wrapped around the sprockets.

(6) In the above-described embodiment, the positions of the bending tools 87, 85 and the cutting tools 83, 81 may be reversed and the tool holders holding the first and second bending tools may be used as the first sub tool holder 141 and the first coaxial tool holder 151. Likewise, the tool holders holding the first and second cutting tools 83, 81 may be used as the second sub tool holder 142 and the second coaxial tool holder 152. In this case, the first bending tool 87 penetrates through the center hole 41B of the first sub tool holder 141 rotating about the first sub rotation axis J1, while the first cutting tool 83 penetrates through the center hole 42B of the second sub tool holder 142 rotating about the second sub rotation axis J2.

Supplemental Note

The limitation in the claims "rotatably supported by a supporting base" is not limited to being rotatably supported directly by a supporting base, and includes being rotatably supported indirectly by a supporting base (for example, rotatably supported by a component rotatably supported by a supporting base). The same holds true to the limitation "rotatably supported by a holder supporting table". Further, for example, as in claim 2, "including a first sub tool holder and a second sub tool holder" also means that "including at least a first sub tool holder and a second sub tool holder", and does not exclude including three or more sub tool holders. The same holds true for "including a first coaxial tool holder and a second coaxial tool holder" and the like.

DESCRIPTION OF THE REFERENCE NUMERAL

10 wire forming machine
11 supporting frame
28 supporting base
31 holder supporting table
31M servomotor (second control drive source)
40 main tool holder

40G, 41G, 42G first side gear
40M servomotor (first control drive source)
41 first sub tool holder
42 second sub tool holder
43G first idle gear
44G second idle gear
45G, 51G, 52G second side gear
51 first coaxial tool holder
51M servomotor (third control drive source)
52 second coaxial tool holder
81 second cutting tool
83 first cutting tool
85 second bending tool
87 first bending tool
87A wire accommodating groove
99 wire
H1 wire feeding direction
J1 first sub rotation axis
J2 second sub rotation axis
J3 main rotation axis
J4 idle rotation axis

What is claimed is:

1. A wire forming machine forming or cutting, with a plurality of tools, a wire fed in a wire feeding direction, the wire forming machine comprising:

a supporting base;

a main tool holder rotatably supported by the supporting base about a main rotation axis perpendicular to the wire feeding direction, the main tool holder holding a first one of the plurality of tools;

a first motor configured to control a position of the main tool holder at an arbitrary rotation position;

a holder supporting table rotatably supported by the supporting base about the main rotation axis;

a second motor configured to control a position of the holder supporting table at an arbitrary rotation position about the main rotation axis;

a first sub tool holder rotatably supported by the holder supporting table about a first sub rotation axis parallel to the main rotation axis, the first sub tool holder holding a second one of the plurality of tools; and a first interlock mechanism inerlockingly and rotatably coupling the first sub tool holder to the main tool holder to rotate the first sub tool holder by the first motor.

2. The wire forming machine according to claim 1, further comprising a second sub tool holder rotatably supported by the holder supporting table about a second sub rotation axis parallel to the main rotation axis, the second sub tool holder holding a third one of the plurality of tools, wherein the first interlock mechanism interlockingly and rotatably couples both of the first sub tool holder and the second sub tool holder to the main tool holder to rotate both of the first sub tool holder and the second sub tool holder by the first motor.

3. The wire forming machine according to claim 2, further comprising:

a first coaxial tool holder arranged coaxially with the first sub tool holder and rotatably supported by the holder supporting table about the first sub rotation axis, the first coaxial tool holder holding a fourth one of the plurality of tools;

a second coaxial tool holder arranged coaxially with the second sub tool holder and rotatably supported by the holder supporting table about the second sub rotation axis, the second coaxial tool holder holding a fifth one of the plurality of tools;

a second interlock mechanism interlockingly and rotatably coupling the first coaxial tool holder to the second coaxial tool holder; and a third motor configured to control a position of each of the first coaxial tool holder and the second coaxial tool holder at an arbitrary rotation position.

4. The wire forming machine according to claim 3, wherein the first interlock mechanism includes a first idle gear rotatably supported by the holder supporting table and three first side gears respectively meshing with three locations in a circumferential direction of the first idle gear and fixed integrally rotatably to the main tool holder, the first sub tool holder, and the second sub tool holder.

5. The wire forming machine according to claim 3, wherein the second interlock mechanism includes a second idle gear rotatably supported by the holder supporting table, a relay member rotatably supported about the main rotation axis and driven to rotate by drive force from the third motor, and three second side gears respectively meshing with three locations in a circumferential direction of the second idle gear and fixed integrally rotatably to the first coaxial tool holder, the second coaxial tool holder, and the relay member.

6. The wire forming machine according to claim 3, wherein a center hole is formed in the first sub tool holder, and a first bending tool is fixed to the first coaxial tool holder, the first bending tool including a shaft extending along the first sub rotation axis and a wire accommodating groove crossing in a radial direction of a tip surface of the shaft, the shaft of the first bending tool penetrates through the center hole and a tip of the shaft projects frontward from the first sub tool holder and a second bending tool laterally opposing to the tip of the shaft of the first bending tool is fixed to the first sub tool holder, a center hole is formed in the second sub tool holder, and a first cutting tool including a blade part at a side surface of the first cutting tool is fixed to the second coaxial tool holder, the first cutting tool penetrates through the center hole, and the first cutting tool projects frontward from the second sub tool holder, a second cutting tool laterally opposing to the first cutting tool is fixed to the second sub tool holder, and a blade part is provided at a side surface of the second cutting tool, the blade part of the second cutting tool being configured to cooperate with the blade part of the first cutting tool to cut the wire.

7. The wire forming machine according to claim 1, further comprising:

a first coaxial tool holder arranged coaxially with the first sub tool holder, and rotatably supported by the holder supporting table about the first sub rotation axis, the first coaxial tool holder holding a third one of the plurality of tools; and a third motor configured to control a position of the first coaxial tool holder at an arbitrary rotation position about the first sub rotation axis.

8. The wire forming machine according to claim 7, further comprising a relay member rotatably supported about the main rotation axis and driven to rotate by the third motor, wherein the first coaxial tool holder is interlockingly and rotatably coupled to the relay member.

9. The wire forming machine according to claim 7, wherein a center hole is formed in the first sub tool holder, and a first bending tool is fixed to the first coaxial tool holder, the first bending tool including a shaft extending along the first sub rotation axis and a wire accommodating groove crossing in a radial direction of a tip surface of the shaft, and the shaft of the first bending tool penetrates through the center hole and a tip of the shaft projects frontward from the first sub tool holder, and a second bending tool laterally opposing to the tip of the shaft of the first bending tool is fixed to the first sub tool holder.

10. The wire forming machine according to claim 7, wherein a center hole is formed in the first sub tool holder, and a first cutting tool including a blade part at a side surface of the first cutting tool is fixed to the first coaxial tool holder, one of the first coaxial tool holder and the first cutting tool penetrates through the center hole, and the first cutting tool projects frontward from the first sub tool holder, a second cutting tool laterally opposing to the first cutting tool is fixed to the first sub tool holder, and a blade part is provided at a side surface of the second cutting tool, the blade part of the second cutting tool being configured to cooperate with the blade part of the first cutting tool to cut the wire.

* * * * *